US007674342B2

(12) United States Patent
Maeda et al.

(10) Patent No.: US 7,674,342 B2
(45) Date of Patent: Mar. 9, 2010

(54) METHOD OF PRODUCING SOFT MAGNETIC MATERIAL, SOFT MAGNETIC POWDER, AND DUST CORE

(75) Inventors: Toru Maeda, Itami (JP); Naoto Igarashi, Itami (JP); Kazuhiro Hirose, Itami (JP); Haruhisa Toyoda, Itami (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 616 days.

(21) Appl. No.: 10/594,961

(22) PCT Filed: Mar. 29, 2005

(86) PCT No.: PCT/JP2005/005885

§ 371 (c)(1),
(2), (4) Date: Sep. 29, 2006

(87) PCT Pub. No.: WO2005/095030

PCT Pub. Date: Oct. 13, 2005

(65) Prior Publication Data

US 2008/0041496 A1 Feb. 21, 2008

(30) Foreign Application Priority Data

Mar. 30, 2004 (JP) ..... 2004-099709

(51) Int. Cl.
*H01F 1/14* (2006.01)

(52) U.S. Cl. ..... 148/121; 148/104; 419/31

(58) Field of Classification Search ..... None
See application file for complete search history.

(56) References Cited

U.S. PATENT DOCUMENTS

| | | | | |
|---|---|---|---|---|
| 6,054,219 | A | 4/2000 | Satsu et al. | |
| 6,773,800 | B2 * | 8/2004 | Hosoe et al. | 428/323 |
| 2007/0235109 | A1 * | 10/2007 | Maeda et al. | 148/307 |

FOREIGN PATENT DOCUMENTS

| | | | |
|---|---|---|---|
| JP | 61-223101 | | 10/1986 |
| JP | 63-121602 | A | 5/1988 |
| JP | 08-060288 | | 3/1996 |
| JP | 8-120393 | | 5/1996 |
| JP | 8-269501 | A | 10/1996 |
| JP | 2002-64027 | | 2/2002 |
| JP | 2002-246219 | A | 8/2002 |
| JP | 2003-282317 | | 10/2003 |
| JP | 2004-79943 | A | 3/2004 |

OTHER PUBLICATIONS

Chinese Office Action issued in Chinese Patent Application No. 200580010065.3, dated Oct. 10, 2008.
Japanese Notice of Grounds of Rejection, w/ English translation thereof, issued in Japanese Patent Application No. JP 2004-099709 dated Nov. 24, 2009.

* cited by examiner

*Primary Examiner*—John P. Sheehan
(74) *Attorney, Agent, or Firm*—McDermott Will & Emery LLP

(57) ABSTRACT

A method of producing a soft magnetic material includes the steps of preparing soft magnetic powder containing a plurality of soft magnetic particles etching the soft magnetic powder to remove surfaces of the soft magnetic particles and, after the etching step, heat-treating the soft magnetic powder in a finely divided state at a temperature of not less than 400° C. and not more than 900° C. By this method configured as above, desired magnetic characteristics can be obtained.

5 Claims, 5 Drawing Sheets

METHOD OF PRODUCING SOFT MAGNETIC MATERIAL, SOFT MAGNETIC POWDER, AND DUST CORE

RELATED APPLICATIONS

This application is the U.S. National Phase under 35 U.S.C. §371 of International Application No. PCT/JP2005/005885, filed on Mar. 29, 2005, which in turn claims the benefit of JP2004-099709, filed on Mar. 30, 2004, the disclosures of which Applications are incorporated by reference herein.

TECHNICAL FIELD

The present invention generally relates to a method of producing a soft magnetic material, soft magnetic powder, and a dust core, and more particularly to a method of producing a soft magnetic material containing a plurality of soft magnetic particles covered with an insulating film, metal magnetic powder, and a dust core.

BACKGROUND ART

Conventionally, attempts have been made to scale electric and electronic components such as motor and transformer cores to higher densities and smaller sizes and to allow more precise control to be effected using low electric power. This has led to development of soft magnetic materials used in producing such electric and electronic components, particularly soft magnetic materials having superior magnetic characteristics in the middle to high frequency range.

In conjunction with such soft magnetic materials, Japanese Patent Laying-Open No. 2002-246219, for example, discloses a dust core aimed at maintaining magnetic characteristics during use under a high temperature environment, and a method of producing thereof (Patent Document 1). According to the method of producing the dust core disclosed in Patent Document 1, atomized iron powder covered with a phosphate film is first mixed with a predetermined amount of polyphenylene sulfide (PPS resin) and is subjected to a compacting process. The resulting compact is heated in air at a temperature of 320° C. for one hour and then heated at a temperature of 240° C. for another one hour. The compact is then cooled to produce a dust core.

Patent Document 1: Japanese Patent Laying-Open No. 2002-246219

DISCLOSURE OF THE INVENTION

Problems to be Solved by the Invention

The dust core fabricated in this way may include numerous grain discontinuities (dislocations, grain boundary, defects) in its interior, which will prevent the movement of a domain wall (change in magnetic flux), resulting in a decrease in magnetic permeability of the dust core and an increase in coercivity. In the case of the dust core disclosed in Patent Document 1, the internal grain discontinuities are not well eliminated even by the two heat treatments applied to the compact. Consequently, the effective magnetic permeability of the resulting dust core, which may vary depending on the frequency and the content of the PPS resin, always remains at a low value of 400 or below.

It is contemplated to perform the heat treatment to the compact at a temperature of not less than 1000° C. in order to well reduce the grain discontinuities within the dust core. However, the phosphate compound covering the atomized iron powder has low heat resistance and thus deteriorates during the heat treatment at high temperature. This results in a phosphate covered atomized iron powder with increased eddy current loss between particles, which may reduce the magnetic permeability of the dust core.

Therefore, an object of the present invention is to solve the above-described problems and to provide a method of producing a soft magnetic material providing desired magnetic characteristics, soft magnetic powder, and a dust core.

Means for Solving the Problems

The grain discontinuities within the dust core includes, in addition to strain as typified by dislocations introduced in the pressure forming of the soft magnetic powder, a grain boundary of a surface layer micrograin formed along the surface of the soft magnetic particle, and a grain boundary of a subgrain formed within the soft magnetic particle. These grain boundaries are formed, for example, in the atomization process for producing the soft magnetic powder, by thermal stress strain in the forced rapid cooling of the soft magnetic powder.

These grain boundaries become a factor which significantly increases the coercivity of the soft magnetic powder. However, these grain boundaries are inherently energetically stable and therefore can be eliminated only by a heat treatment at a high temperature of not less than 1000° C., for example. The present inventors paid attention to the surface layer micrograin formed along the surface of the soft magnetic particle and have completed the present invention which is capable of sufficiently reducing the coercivity even by a heat treatment at a relatively low temperature.

The method of producing a soft magnetic material according to one aspect of the present invention includes the steps of preparing soft magnetic powder containing a plurality of soft magnetic particles, etching the soft magnetic powder to remove surfaces of the soft magnetic particles, and, after the etching step, performing a first heat treatment on the soft magnetic powder in a finely divided state at a temperature of not less than 400° C. and not more than 900° C.

According to the method of producing the soft magnetic material configured as above, the surface of the soft magnetic particle along which a surface layer micrograin is formed can be removed by etching the soft magnetic powder before the first heat treatment. This allows the soft magnetic powder not having the grain boundary of the surface layer micrograin to be subjected to the first heat treatment. Therefore, the remaining grain discontinuities can be effectively eliminated by the first heat treatment. As a result, it is possible to obtain the soft magnetic powder with sufficiently low coercivity.

In this case, the above-described effect by the first heat treatment can be sufficiently achieved by the heat treatment performed at a temperature of not less than 400° C. In addition, the heat treatment at a temperature of not less than 900° C. can prevent the soft magnetic powder from being sintered and solidified in the heat treatment. If the soft magnetic powder is sintered, the solidified soft magnetic powder needs to be mechanically broken into pieces. This may raise the possibility of new strain within the soft magnetic particle. Therefore, such possibility can be avoided by the heat treatment at a temperature of not more than 900° C.

Preferably, after the etching step, the soft magnetic powder has a particle size distribution substantially existing only in the range of not less than 10 μm and not more than 400 μm. According to the method of producing the soft magnetic material configured as above, the soft magnetic powder with a particle size distribution of not less than 10 μm can suppress the effect of "stress strain by surface energy". "Stress strain by surface energy" described herein refers to the stress strain resulting from strain and defects existing on the surface of the soft magnetic particle, which will lead to prevent the movement of the domain wall. Thus, the coercivity of the soft magnetic powder can be reduced by suppressing the above-mentioned effect. Furthermore, the particle size distribution of not less than 10 μm can prevent the soft magnetic powder from being solidified. The particle size distribution of not more than 400 μm can reduce eddy current loss between particles of the dust core, when produced using the producing method according to the present invention. This allows iron loss of the dust core resulting from eddy current loss between particles to be reduced.

Preferably, the etching step includes the step of removing the surfaces of the soft magnetic particles such that an average particle diameter of the soft magnetic powder prepared by the preparing step is reduced to a value in a range of not less than 90% relative to the average particle diameter. The method of producing the soft magnetic material configured as above is advantageous in that the soft magnetic particles do not become too small in size relative to the original average particle diameter and prevent an increase of the effect of a shape demagnetization field, and also prevent an increase of the effect of "stress strain by surface energy". This allows the coercivity of the resulting soft magnetic powder to be reduced.

The soft magnetic powder according to the present invention is produced using the method of producing the soft magnetic material set forth above. This soft magnetic powder has a coercivity which is reduced to a value of not more than 70% relative to the coercivity of the soft magnetic powder prepared by the preparing step. The method of producing the soft magnetic material according to the present invention is used to allow the coercivity of the soft magnetic powder to be reduced to a value of not more than 70% from its original value.

Preferably, the method of producing the soft magnetic material further includes the steps of, after the step of performing the first heat treatment, forming an insulating film on each of the plurality of soft magnetic particles, and preparing a compact by pressure-forming the plurality of soft magnetic particles each having the insulating film formed thereon. According to the method of producing the soft magnetic material configured as above, since the insulating film is formed after the first heat treatment, the first heat treatment does not lead to deterioration of the insulating film.

Since the compact is formed using the soft magnetic powder in which the grain discontinuities are well eliminated, most of the grain discontinuities existing within the compact are caused by strain occurred in the pressure-forming. Thus, the grain discontinuities within the compact can be reduced easily. Furthermore, the soft magnetic particle with the grain discontinuities reduced is in a state which can be easily deformed in the pressure-forming. Therefore, the compact can be obtained in such a state that the plurality of soft magnetic particles are engaged with each other without gaps, to thereby allow the compact density to be increased.

Preferably, the method of producing the soft magnetic material further includes the step of adding organic matter to the soft magnetic powder before the step of preparing the compact. According to the method of producing the soft magnetic material configured as above, in the pressure-forming, the organic matter intervenes between each of the soft magnetic particles having the insulating films formed thereon. Therefore, the organic matter serves as a lubricant in the pressure-forming and prevents breakage of the insulating film. After the pressure-forming, the organic matter also serves to bond the soft magnetic particles to each other. This allows the strength of the compact to be increased.

Preferably, the method of producing the soft magnetic material further includes the step of performing a second heat treatment of the compact at a temperature of at least 30° C. and less than a thermal decomposition temperature of the insulating film. According to the method of producing the soft magnetic material configured as above, the second heat treatment allows the grain discontinuities existing within the compact to be reduced. In this case, the grain discontinuities within the soft magnetic powder have been sufficiently reduced in advance in the first heat treatment. As a result, most of the grain discontinuities within the compact are caused by strain occurred in the pressure-forming. Therefore, strain existing within the compact can be sufficiently reduced even at a relatively low heat treatment temperature of less than the thermal decomposition temperature of the insulating film, for example, less than 500° C. in the case of a conventional phosphate insulating film.

In addition, in the second heat treatment, since the temperature in the heat treatment is less than the thermal decomposition temperature of the insulating film, the insulating film surrounding the soft magnetic particle can be prevented from deterioration. This allows eddy current loss between particles occurring between the soft magnetic particles to be reduced by the properly protected insulating films. The heat treatment temperature of not less than 30° C. can also achieve the above-described effect by the second heat treatment at a certain level.

The dust core according to the present invention is produced using the above-described method of producing the soft magnetic material. The dust core has a coercivity of not more than $1.0\times10^2$ A/m. The dust core configured as above can reduce hysteresis loss of the dust core because of its sufficiently low coercivity. This allows the dust core to be effectively utilized also in a low frequency domain which has a large proportion of the hysteresis loss in iron loss.

EFFECTS OF THE INVENTION

As described above, according to the present invention, a method of producing a soft magnetic material that provides desired magnetic characteristics, soft magnetic powder and a dust core can be provided.

DESCRIPTION OF THE REFERENCE CHARACTERS

10 soft magnetic particle, 10*a* surface, 20 insulating film, 30 composite magnetic particle, 40 organic matter.

BEST MODES FOR CARRYING OUT THE INVENTION

Embodiments of the present invention will be described with reference to the drawings.

Figure 1:
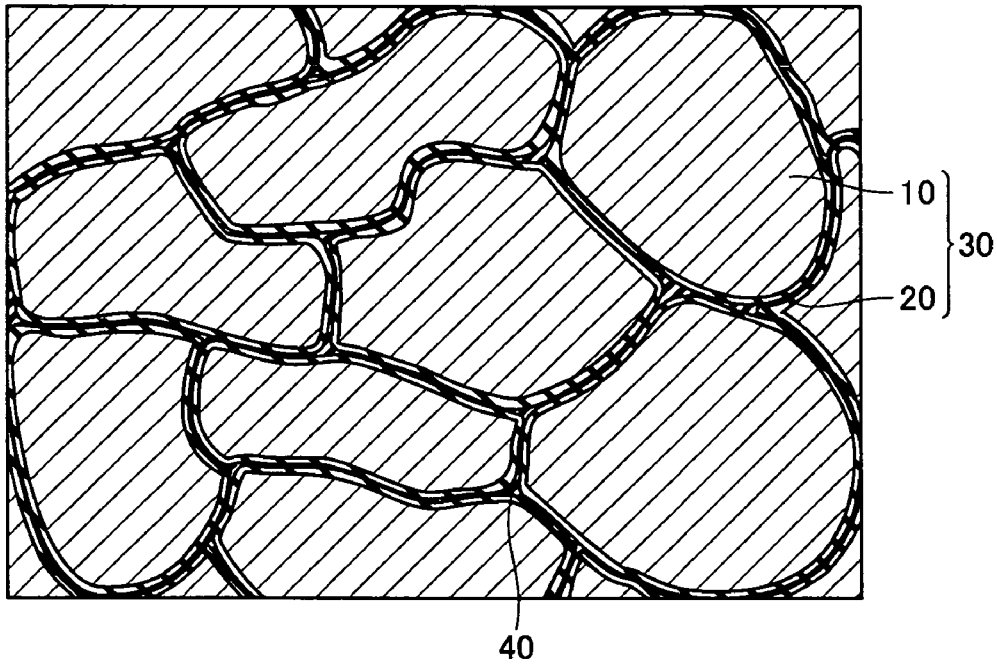
FIG. 1 is a schematic view of a cross section of a dust core produced by a method of producing a soft magnetic material according to an embodiment of the present invention.

Referring to FIG. 1, a dust core includes a plurality of composite magnetic particles 30 each formed of a soft magnetic particle 10 and an insulating film 20 surrounding a surface of soft magnetic particle 10. Organic matter 40 is disposed between the plurality of composite magnetic particles 30. Each of the plurality of composite magnetic particles 30 is bonded to each other through organic matter 40, or bonded to each other through engagement of protrusions and recesses of composite magnetic particles 30. Organic matter 40 firmly bonds composite magnetic particles 30 together to improve the strength of the dust core.

Soft magnetic particle 10 can be made of, for example, iron (Fe), an iron (Fe)-silicon (Si) alloy, an iron (Fe)-nitrogen (N) alloy, an iron (Fe)-nickel (Ni) alloy, an iron (Fe)-carbon (C) alloy, an iron (Fe)-boron (B) alloy, an iron (Fe)-cobalt (Co) alloy, an iron (Fe)-phosphorus (P) alloy, an iron (Fe)-nickel (Ni)-cobalt (Co) alloy, an iron (Fe)-aluminum (Al)-silicon (Si) alloy and the like. Soft magnetic particle 10 may be of a simple substance of metal or an alloy.

Insulating film 20 is formed, for example, by treating soft magnetic particle 10 with phosphoric acid. Further, insulating film 20 preferably contains an oxide. As insulating film 20 containing the oxide, an oxide insulator can be used, such as, in addition to iron phosphate containing phosphorus and iron, manganese phosphate, zinc phosphate, calcium phosphate, aluminum phosphate, silicon oxide, titanium oxide, aluminum oxide, or zirconium oxide. Insulating film 20 may be formed in a single layer as shown in the drawing, or may be formed in multiple layers.

Insulating film 20 serves as an insulating layer between soft magnetic particles 10. By covering soft magnetic particle 10 with insulating film 20, electric resistivity ρ of the dust core can be increased. Thus, eddy current can be prevented from flowing between soft magnetic particles 10, to thereby reduce iron loss of the dust core resulting from the eddy current.

As organic matter 40, thermoplastic resin such as thermoplastic polyimide, thermoplastic polyamide, thermoplastic polyamidimide, polyphenylene sulfide, polyamidimide, polyethersulfone, polyether imide or polyetheretherketone; non-thermoplastic resin such as wholly aromatic polyester or wholly aromatic polyimide; and higher fatty acid such as high-molecular-weight polyethylene, zinc stearate, lithium stearate, calcium stearate, lithium palmitate, calcium palmitate, lithium oleate and calcium oleate can be employed. These can also be employed in combination with each other. A high-molecular-weight polyethylene refers to a polyethylene having a molecular weight of not less than 100,000.

A method of producing a soft magnetic material according to the embodiment will then be described using FIGS. 2 to 8.

Figure 2:
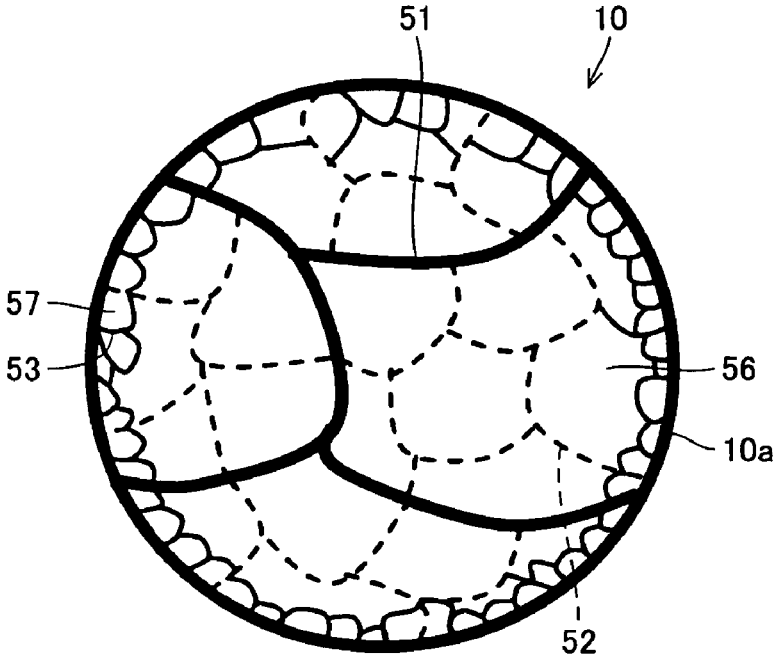
FIG. 2 is a schematic view showing a state of a soft magnetic particle obtained in an atomization process of producing the dust core as shown in FIG. 1.

Referring to FIG. 2, first, an atomization method is used to produce soft magnetic powder made of plurality of soft magnetic particles 10. More specifically, dissolved source metal is pulverized by using high-pressure water to spray and rapidly quench the metal, and thus, the plurality of soft magnetic particles 10 are produced. Soft magnetic particle 10 obtained by this rapid quenching step includes, in addition to a grain boundary 51 extending between grains, a surface layer microgram 57 formed along a surface 10*a* with a predetermined depth, a surface layer micrograin boundary 53 extending between surface layer micrograins 57, a subgrain 56 formed within soft magnetic particle 10, and a subgrain boundary 52 extending between subgrains 56. It is to be noted that the method of producing the soft magnetic powder is not limited to a water atomization method and may be a gas atomization method.

Figure 3:
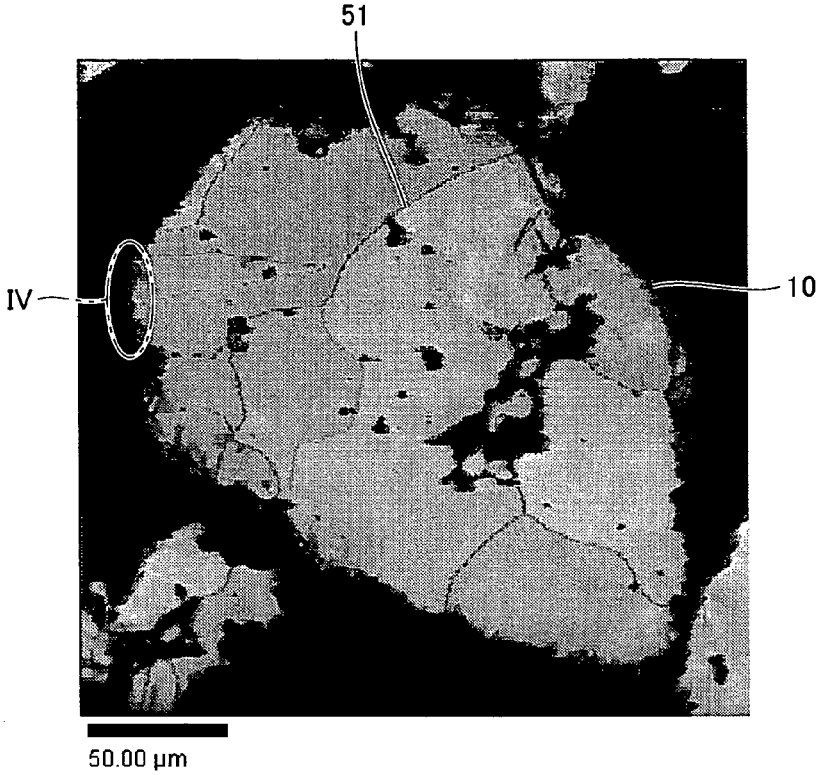
FIG. 3 is a picture of a SEM-EBSP image (scanning electron microscope-electron back scattering pattern) of the soft magnetic particle schematically shown in FIG. 2.
Figure 4:
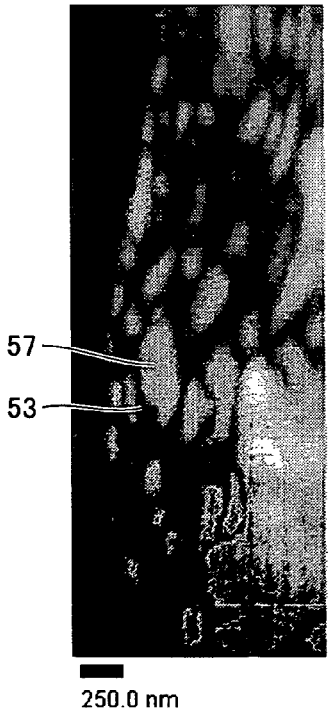
FIG. 4 is an enlarged view of the soft magnetic particle showing the area defined by a chain line with two dots IV shown in FIG. 3.

FIGS. 3 and 4 show atomized iron powder with a purity of not less than 99.8% produced by the water atomization method. Referring to FIGS. 3 and 4, in the case of using the water atomization method, soft magnetic particle 10 with a diameter of about 100 μm has surface layer micrograin 57 formed at a depth of about 100 nm to 250 nm from the surface. On the other hand, in the case where the gas atomization method is used to produce the soft magnetic powder, the formed depth of the surface layer micrograin is relatively shallow, which is in the vicinity of 10 nm relative to the diameter of about 100 μm. However, the formed depth of the surface layer micrograin described herein is an example, and varies with the quality and the particle size of the soft magnetic particle, the conditions of producing the soft magnetic powder, and the like.

Figure 5:
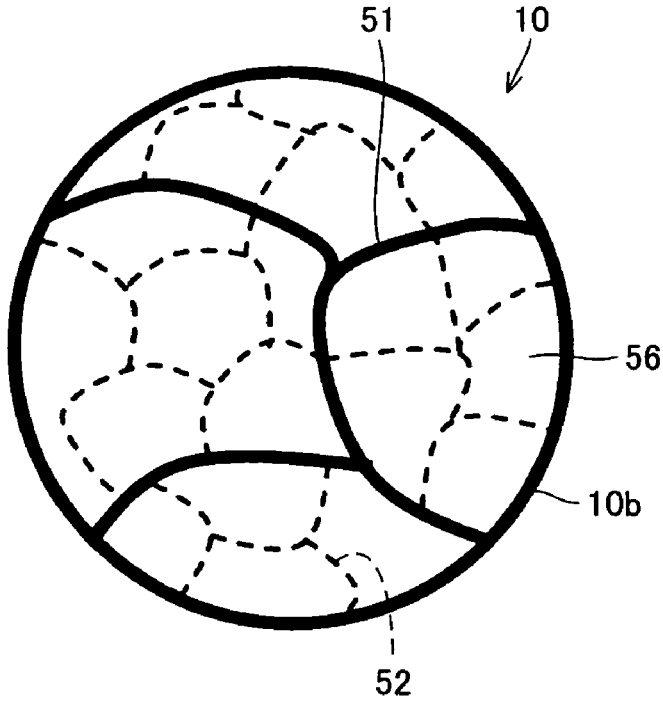
FIG. 5 is a schematic view showing a state of the soft magnetic particle obtained in an etching step of producing the dust core shown in FIG. 1.

Referring to FIG. 5, the soft magnetic powder is then subjected to an etching process by introducing the soft magnetic powder into hydrogen chloride (HCl) aqueous solution (hydrochloric acid) and performing a stirring process for a predetermined time. In this case, in addition to hydrochloric acid, phosphoric acid ($H_3PO_4$), nitric acid ($HNO_3$), sulfuric acid ($H_2SO_4$) and a mixed solution thereof can be used. In addition to the acid treatment using these aqueous solutions, for example, an argon ion milling method performed using an ion milling device and a reactive ion etching method using active species of reactive gas in plasma can also be used.

The above-described etching process removes the surface of soft magnetic particle 10 along a predetermined depth from surface 10*a*, to thereby remove surface layer micrograin 57 formed in soft magnetic particle 10 from soft magnetic particle 10. In this case, the etching process is preferably performed such that the average particle size of the soft magnetic powder after the etching process takes a value of not less than 90% of the average particle size of the soft magnetic powder before the etching process. The average particle size described herein refers to a particle size obtained when the sum of masses of particles added in ascending order of particle size in a histogram of particle sizes measured by a laser scatter diffraction method and the like reaches 50% of the total mass, that is, 50% particle size D.

It is also preferable that, after the etching process, the particle size of soft magnetic particle 10 is substantially distributed only in the range of not less than 10 μm and not more than 400 μm. In this case, any particle with a size of less than 10 μm and any particle with a size of greater than 400 μm may be forcefully removed from the soft magnetic powder after the etching process, by using a sieve with appropriate mesh size. It is further preferable that the particle size of soft magnetic particle 10 is substantially distributed only in the range of not less than 75 μm and not more than 355 μm.

The soft magnetic powder subjected to the etching process is then washed, and the soft magnetic powder is subsequently dried by replacing moisture with acetone.

Figure 6:
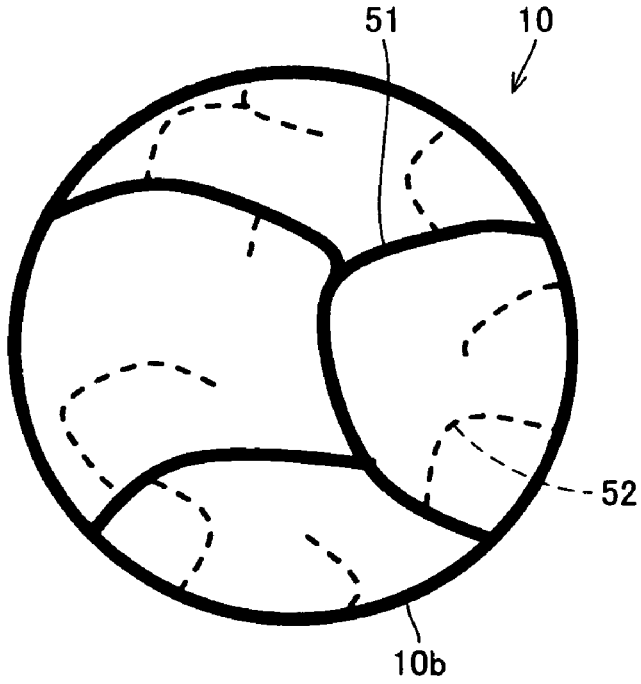
FIG. 6 is a schematic view showing a state of the soft magnetic particle obtained in a first heat treatment step of producing the dust core shown in FIG. 1.

Referring to FIG. 6, the soft magnetic powder is then subjected to a heat treatment at a temperature of not less than 400° C. and not more than 900° C., for example, for one hour. The heat treatment is further preferably performed at a temperature of not less than 700° C. and not more than 900° C. If this heat treatment leaves subgrain boundary 52 formed within soft magnetic particle 10 and the surface layer micrograin on a new surface 10*b* of soft magnetic particle 10, the grain boundary by the surface layer micrograin is caused to be eliminated. In this case, since the etching process performed in the previous step causes all or most of the surface layer micrograins to be previously removed, the grain discontinuities existing within soft magnetic particle 10 can be effectively eliminated.

Figure 7:
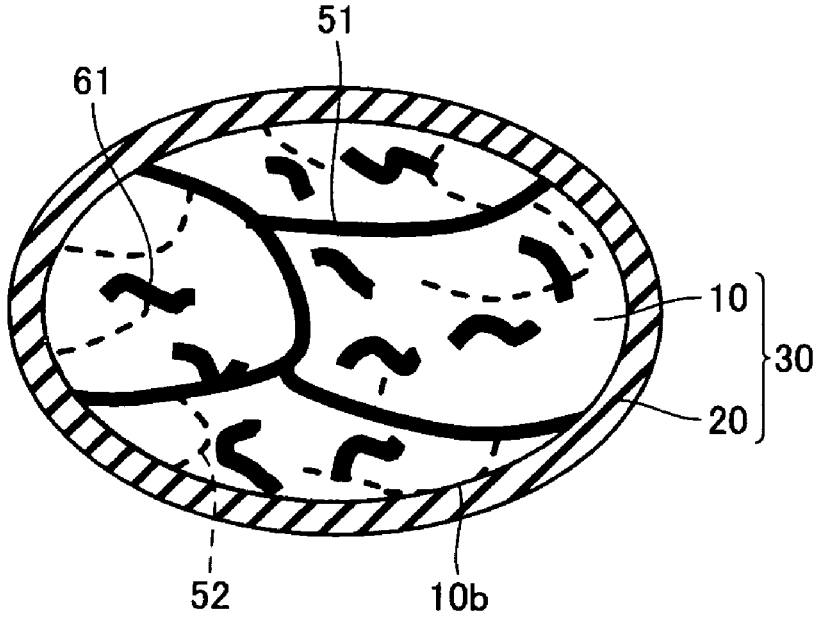
FIG. 7 is a schematic view showing a state of the soft magnetic particle obtained in a pressure-forming step of producing the dust core shown in FIG. 1.

Referring to FIG. 7, insulating film 20 is formed on surface 10*b* of soft magnetic particle 10 to produce composite magnetic particles 30. Mixed powder is then obtained by adding organic matter 40 to resulting composite magnetic particles 30 and mixing together. There is no specific limitation on the mixing technique, and any technique such as mechanical alloying, vibratory ball milling, planetary ball milling, mechanofusion, coprecipitation, chemical vapor deposition (CVD), physical vapor deposition (PVD), plating, sputtering, vapor deposition, or sol-gel process may be used.

The obtained mixed powder is then introduced into a mold and pressure-formed under a pressure of 700 MPa to 1500 MPa, for example. This results in compression of the mixed powder to create a compact. The mixed powder is preferably pressure-formed in an inert gas atmosphere or a decompressed atmosphere. In this case, the mixed powder can be prevented from oxidation by oxygen in the atmosphere. This pressure-forming causes strain 61 to be newly created in soft magnetic particle 10.

In this case, most of surface layer micrograin boundary 53 and subgrain boundary 52 originally existing within soft magnetic particle 10 are eliminated by the etching process as described using FIG. 5 and the heat treatment as described using FIG. 6. Thus, composite magnetic particle 30 is in a state which is easily deformed in the pressure-forming. Therefore, the compact can be formed in such a manner that the plurality of composite magnetic particles 30 are engaged with each other without gaps, as shown in FIG. 1. This allows an increase in the density of the compact, to thereby achieve high magnetic permeability. Organic matter 40 is located between adjacent composite magnetic particles 30 to serve as a lubricant and prevent breakage of insulating film 20 due to rubbing of composite magnetic particles 30 against each other.

Figure 8:
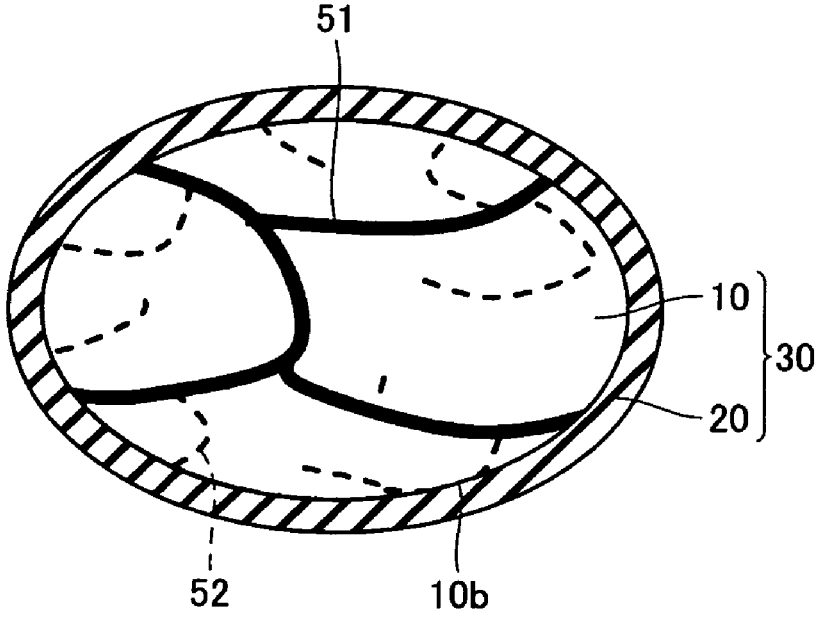
FIG. 8 is a schematic view showing a state of the soft magnetic particle obtained in a second heat treatment step of producing the dust core shown in FIG. 1.

Referring to FIG. 8, the compact obtained by the pressure-forming is then heat-treated at a temperature of not less than 30° C. and less than the thermal decomposition temperature of insulating film 20. Insulating film 20 has a thermal decomposition temperature of, for example, 500° C. in the case of a phosphate insulating film.

In this case, since most of surface layer micrograin boundary 53 and subgrain boundary 52 originally existing within soft magnetic particle 10 are eliminated, the amount of the grain discontinuities within the compact is relatively small even after the pressure-forming. Furthermore, since there are few grain discontinuities within soft magnetic particle 10 in the pressure-forming, new strain 61 is created without complexly intertwining with these grain discontinuities. For these reasons, the grain discontinuities existing within the compact can be easily reduced despite that the heat treatment is carried out at a relatively low temperature of less than the thermal decomposition temperature of insulating film 20.

Since the heat treatment on the compact is performed at a temperature of less than the thermal decomposition temperature of insulating film 20, the heat treatment does not lead to deterioration of insulating film 20. This keeps insulating film 20 covering soft magnetic particle 10 even after the heat treatment, and allows insulating film 20 to reliably prevent an eddy current from flowing between soft magnetic particles 10. More preferably, the compact obtained by the pressure-forming is heat-treated at a temperature of not less than 30° C. and not more than 300° C. In this case, insulating film 20 can be further prevented from deterioration.

The resulting compact is thereafter subjected to an appropriate treatment such as extrusion or cutting to provide a finished dust core as shown in FIG. 1.

The method of producing the soft magnetic material according to the embodiment of the present invention includes the steps of preparing the soft magnetic powder containing the plurality of soft magnetic particles 10, etching the soft magnetic powder to remove surfaces 10*a* of soft magnetic particles 10, and, after the etching step, performing the heat treatment of the soft magnetic powder in a finely divided state at a temperature of not less than 400° C. and not more than 900° C.

According to the method of producing the soft magnetic material configured as above, soft magnetic particle 10 before the pressure-forming is subjected to the etching process and also to the heat treatment at a predetermined range of the temperature, to allow production of the dust core with the grain discontinuities well eliminated. This allows hysteresis loss of the dust core to be reduced. Since the heat treatment to the soft magnetic powder is carried out before insulating film 20 is formed on soft magnetic particle 10, the heat treatment does not lead to deterioration of insulating film 20. Furthermore, since the heat treatment to the compact is carried out at a temperature of less than the thermal decomposition temperature of insulating film 20, deterioration of insulating film 20 by the heat treatment is also suppressed. This allows insulating film 20 to serve well as an insulating layer between soft magnetic particles 10 and eddy current loss of the dust core to be reduced. As a result, iron loss of the dust core can be significantly reduced through reduction in hysteresis loss and eddy current loss.

EXAMPLE

The method of producing the soft magnetic material according to the present invention was evaluated by the examples described below.

Example 1

According to the producing method described in the embodiment, the soft magnetic powder was first subjected to the etching process. In this case, as soft magnetic particle 10, water-atomized iron powder with a purity of not less than 99.8% (product name "ABC100.30" manufactured by Höganäs AB) was used. The etching process was carried out by preparing hydrogen chloride aqueous solution with a concentration of 3% by mass (600 $cm^3$), introducing 200 grams of the soft magnetic powder into the solution and stirring the solution. In this case, different stirring times in a range of 10 minutes to 300 minutes were employed to produce the plurality of soft magnetic powders which were subjected to the etching process under different conditions. The soft magnetic powder which was not subjected to the etching process was also prepared for comparison purposes.

The average particle size and coercivity of the soft magnetic powder produced as above were measured. When the coercivity was measured, a resin binder was first used to solidify the soft magnetic powder and produce a pellet (20 mm in diameter, 5 mm in thickness). A magnetic field was applied to the pellet in the sequence of 1 (T: tesla), −1 T, 1 T and −1 T, and a vibrating sample magnetometer (VSM) was used to specify the shape of a B (magnetic flux) H (magnetic field) loop at the time. From the shape of this BH loop was calculated the coercivity of the pellet whose value was assumed to be the coercivity of the soft magnetic powder.

The soft magnetic powder was then subjected to the heat treatment under conditions at a temperature of 850° C. in a hydrogen gas stream for one hour. The coercivity of the soft magnetic powder after the heat treatment was measured by the similar method as above.

The soft magnetic powder was then covered with a film to form a phosphate iron film as insulating film 20 on the surface of soft magnetic particle 10. Polyphenylene sulfide (PPS resin) was added to the soft magnetic powder covered with the film in a proportion of 1% by mass relative to the soft magnetic powder, and mixed together. The resulting mixed powder was press-formed at a surface pressure of 13 ton/cm$^2$ to produce the compact in a ring shape (34 mm in outer diameter, 20 mm in inner diameter, 5 mm in thickness). By winding a coil around the obtained compact (300 turns for the primary and 20 turns for the secondary) and applying a magnetic field to the compact, the coercivity and the magnetic permeability of the compact were measured.

The compact was then subjected to the heat treatment under conditions at a temperature of 550° C. in a nitrogen gas stream for one hour. The coercivity and the magnetic permeability of the compact after the heat treatment was measured by the similar method as above. Values of the coercivity and the magnetic permeability of the soft magnetic powder and the compact obtained by the above-described measurement are shown in Table 1.

As can be seen from Table 1, the soft magnetic powder with the stirring time of not more than 60 minutes achieved the average particle size which was kept to a value of not less than 90% relative to the average particle size before the etching process. In this case, the coercivity after the heat treatment could be reduced as compared to the soft magnetic powder which was not subjected to the etching process. In particular, the coercivity could be effectively reduced with the stirring time in the range of 30 to 40 minutes. It is thought that the reason why the coercivity was increased with increasing stirring time in the range of not less than 60 minutes was that soft magnetic particle 10 with the particle size reduced too much caused the effects of the shape diamagnetic field and stress strain by surface energy to exceed the effect of eliminating the surface layer micrograin boundary by the etching process.

More specifically, if no processing was performed, the original coercivity of the soft magnetic powder was 2.86 (Oe: oersted). If the heat treatment was performed, a coercivity of 2.20 (Oe) was achieved, which was about 77% of the original coercivity. On the other hand, when stirring was performed for 30 minutes in the etching process, the coercivity after the heat treatment was 1.95 (Oe), which was a value of about 68% relative to 2.86 (Oe). Thus, it was possible to confirm that the coercivity of the soft magnetic powder could be reduced to a value of not more than 70% according to the present invention.

In accordance with the reduced coercivity of the soft magnetic powder as described above, each coercivity of the compact obtained by the pressure forming and the compact further subjected to the heat treatment could be reduced and each magnetic permeability thereof could be increased. Particularly in the case of the processing time in the range of 30 minutes to 40 minutes, the coercivity of the compact after the heat treatment could be reduced to a value of not more than 1.30 (Oe) (=1.0×10$^2$ A/m).

Example 2

In the present example, the soft magnetic powder which was used in Example 1 and was not subjected to the etching process and the soft magnetic powder which was stirred for 30 minutes in the etching process were subjected to the heat treatment under conditions at different heat treatment temperatures in the hydrogen gas stream for one hour. Each

TABLE 1

| | Soft Magnetic Powder | | | Compact | | | |
|---|---|---|---|---|---|---|---|
| Stirring Time (min.) | Average Particle Size after Etching Process (μm) | Coercivity after Etching Process (Oe) | Coercivity after Heat Treatment (Oe) | Coercivity after Pressure Forming (Oe) | Magnetic Permeability after Pressure Forming | Coercivity after Heat Treatment (Oe) | Magnetic Permeability after Heat Treatment |
| 0 | 83 | 2.86 | 2.20 | 4.28 | 573 | 1.52 | 954 |
| 10 | 82 | 2.84 | 2.16 | 4.22 | 582 | 1.46 | 1008 |
| 20 | 80 | 2.77 | 2.11 | 4.13 | 596 | 1.42 | 1066 |
| 30 | 80 | 2.54 | 1.95 | 3.74 | 635 | 1.26 | 1164 |
| 40 | 76 | 2.61 | 2.03 | 3.96 | 615 | 1.30 | 1122 |
| 60 | 76 | 2.74 | 2.10 | 4.01 | 566 | 1.36 | 1040 |
| 90 | 74 | 2.96 | 2.23 | 4.19 | 530 | 1.55 | 922 |
| 120 | 70 | 3.11 | 2.29 | 4.25 | 508 | 1.62 | 901 |
| 150 | 68 | 3.14 | 2.27 | 4.26 | 482 | 1.69 | 888 |
| 180 | 67 | 3.13 | 2.31 | 4.29 | 468 | 1.80 | 842 |
| 240 | 63 | 3.25 | 2.36 | 4.30 | 452 | 1.83 | 831 |
| 300 | 59 | 3.37 | 2.42 | 4.38 | 429 | 1.86 | 779 |

coercivity of the soft magnetic powder treated at respective heat treatment temperatures was measured by a method similar to that of Example 1. Values of each coercivity obtained by the measurement are shown in Table 2 and plotted values are shown in FIG. 9.

TABLE 2

| Temperature of First Heat Treatment on Soft Magnetic Powder (° C.) | Stirring Time 0 (min.) Coercivity of Soft Magnetic Powder after Heat Treatment (Oe) | Stirring Time 30 (min.) Coercivity of Soft Magnetic Powder after Heat Treatment (Oe) |
|---|---|---|
| 25 | 2.86 | 2.54 |
| 250 | 2.82 | 2.52 |
| 300 | 2.78 | 2.49 |
| 350 | 2.74 | 2.46 |
| 400 | 2.68 | 2.41 |
| 450 | 2.62 | 2.36 |
| 500 | 2.55 | 2.29 |
| 550 | 2.48 | 2.2 |
| 600 | 2.4 | 2.13 |
| 650 | 2.33 | 2.08 |
| 700 | 2.28 | 2 |
| 750 | 2.23 | 1.98 |
| 800 | 2.21 | 1.94 |
| 850 | 2.2 | 1.95 |
| 900 | 2.26 (Pulverization Needed) | 2.52 (Pulverization Needed) |
| 950 | 2.66 (Pulverization Needed) | Measurement Not Available (Pulverization Not Available) |
| 1000 | Measurement Not Available (Pulverization Not Available) | Measurement Not Available (Pulverization Not Available) |

Figure 9:
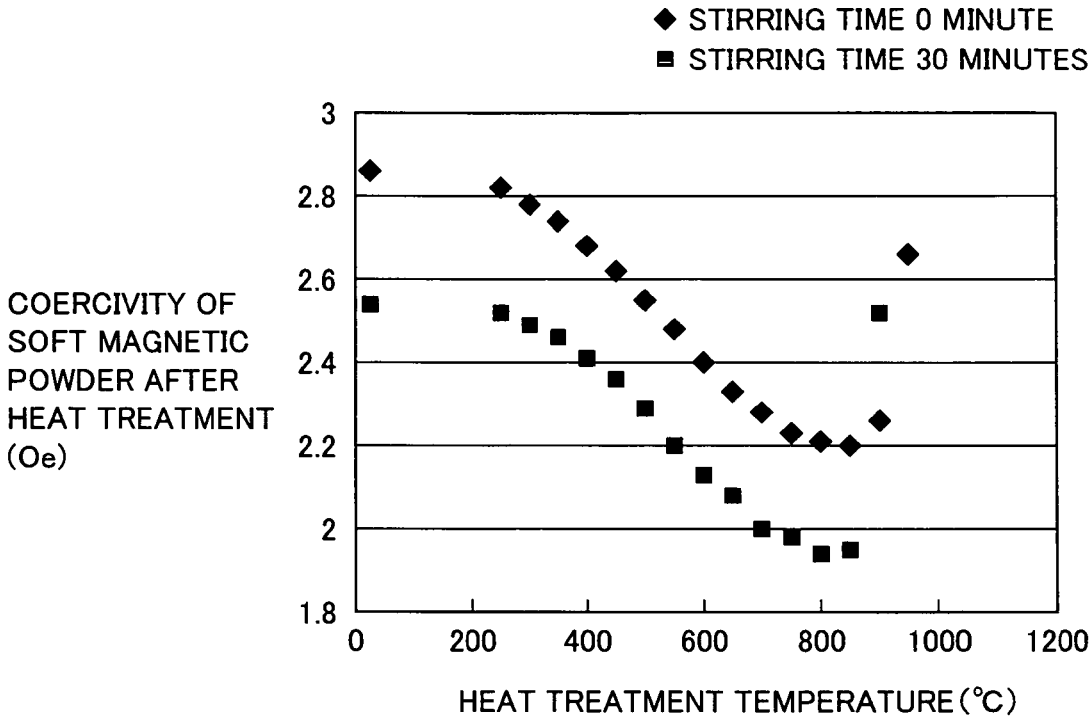
FIG. 9 is a graph showing a relationship between a heat treatment temperature and coercivity of soft magnetic powder in a second embodiment of the present invention.

Referring to Table 2 and FIG. 9, in the case of the heat treatment temperature of 900° C., the heat treatment caused the soft magnetic powder to be slightly solidified to create a need for slight pulverization. As a result, the measured coercivity had an increased value. In the case of the heat treatment temperature of greater than 900° C., the soft magnetic powder was solidified rigidly such that it could not be pulverized in some cases. Also in the case where the solidified soft magnetic powder could be pulverized, the measured coercivity had a significantly increased value. Thus, it was possible to confirm that the coercivity of the soft magnetic powder could be reduced by setting the temperature in the heat treatment on the soft magnetic powder to a temperature of not more than 900° C., for example, 850° C., as performed in Example 1.

It should be understood that the embodiments and examples disclosed herein are illustrative and non-restrictive in every respect. The scope of the present invention is defined by the terms of the claims, rather than the description above, and is intended to include any modifications within the scope and meaning equivalent to the terms of the claims.

INDUSTRIAL APPLICABILITY

The present invention is applicable in manufacturing motor cores, electromagnetic valves, reactors or other electromagnetic components fabricated from pressure-formed soft magnetic powder, for example.

The invention claimed is:

1. A method of producing a soft magnetic material, comprising the steps of:

preparing soft magnetic powder containing a plurality of soft magnetic particles by using an atomization method;

etching said soft magnetic powder to remove surfaces of said soft;

magnetic particles; and after said etching step, performing a first heat treatment of said soft magnetic powder in a finely divided state at a temperature of not less than 400° C. and not more than 900° C., wherein said etching step includes the step of removing surfaces of said soft magnetic particles such that an average particle diameter of the soft magnetic powder prepared by said preparing step is reduced to a value in a range of not less than 90% relative to the average particle diameter.

2. The method of producing the soft magnetic material according to claim 1, wherein, after said etching step, said soft magnetic powder has a particle size distribution substantially existing only in a range of not less than 10 μm and not more than 400 μm.

3. The method of producing the soft magnetic material according to claim 1, further comprising the steps of:

after said step of performing the first heat treatment, forming an insulating film on each of said plurality of soft magnetic particles; and preparing a compact by pressure-forming said plurality of soft magnetic particles each having said insulating film formed thereon.

4. The method of producing the soft magnetic material according to claim 3, further comprising the step of adding organic matter to said soft magnetic powder before said step of preparing the compact.

5. The method of producing the soft magnetic material according to claim 3, further comprising the step of performing a heat treatment of said compact at a temperature of not less than 30° C. and less than a thermal decomposition temperature of said insulating film.

* * * * *